US005118281A

United States Patent [19]

Bramlette et al.

[11] Patent Number: 5,118,281

[45] Date of Patent: Jun. 2, 1992

[54] METHOD AND APPARATUS FOR THE CONTROL OF FLUID DYNAMIC MIXING IN PULSE COMBUSTORS

[75] Inventors: T. Tazwell Bramlette, San Ramon; Jay O. Keller, Oakland, both of Calif.

[73] Assignee: The United States of America as represented by the United States Department of Energy, Washington, D.C.

[21] Appl. No.: 497,004

[22] Filed: Mar. 20, 1990

Related U.S. Application Data

[63] Continuation-in-part of Ser. No. 325,279, Mar. 17, 1989, abandoned.

[51] Int. Cl.[5] ..... F23C 11/04

[52] U.S. Cl. ..... 431/1; 431/75; 431/79; 60/247

[58] Field of Search ..... 431/1, 8, 19, 79, 75, 431/186, 346, 354, 12; 122/24; 60/39.76, 39.81, 39.77

[56] References Cited

U.S. PATENT DOCUMENTS

| | | | |
|---|---|---|---|
| 4,472,132 | 9/1984 | Hisaoka et al. | 431/1 |
| 4,474,547 | 10/1984 | Drexel et al. | 431/1 |
| 4,640,674 | 2/1987 | Kitchen | 431/1 |
| 4,645,448 | 2/1987 | Otto et al. | 431/1 |
| 4,721,458 | 1/1988 | Conrad | 432/205 |
| 4,909,731 | 3/1990 | Zinn et al. | 432/58 |
| 4,929,172 | 5/1990 | Zinn et al. | 431/1 |

FOREIGN PATENT DOCUMENTS

| | | | |
|---|---|---|---|
| 0207828 | 10/1985 | Japan | 431/1 |
| 0626316 | 9/1978 | U.S.S.R. | 431/1 |

OTHER PUBLICATIONS

T. Bramlette, "The Role of Fluid Dynamic Mixing in Pulse Combustors", *Sandia National Laboratories Report, SAND* 87-8622, Apr., 1987.

J. Keller et al., "Response of a Pulse Combustor to Changes in Fuel Compositions", 21st Symposium (International) on Combustion, The Combustion Institute, at Munich, West Germany, Aug. 3-8, 1986, *Sandia National Laboratory Report SAND* 86-8631 and *Proceedings of the 21st Symposium (International) on Combustion*, The Combustion Institute, Pittsburgh, Pa., 1987, pp. 547-555.

J. Keller et al., "Measurements of the Combusting Flow in a Pulse Combustor", *Combustion Science and Technology*, vol. 53, 1987, pp. 137-163.

J. Keller et al., "Pulse Combustion: The Importance of Characteristic Times", *Sandia National Laboratories Report SAND* 87-8783, Jul. 1987.

J. Keller et al., "Pulse Combustion: The Quantification of Characteristic Times", *Sandia National Laboratories Report SAND* 87-8832, Mar. 1988.

*Primary Examiner*—Carl D. Price

*Attorney, Agent, or Firm*—Anne D. Daniel; James H. Chafin; William R. Moser

[57] ABSTRACT

In a method and apparatus for controlling total ignition delay time in a pulse combustor, and thus controlling the mixing characteristics of the combustion reactants and the combustion products in the combustor, the total ignition delay time is controlled by adjusting the inlet geometry of the inlet to the combustion chamber. The inlet geometry may be fixed or variable for controlling the mixing characteristics. A feedback loop may be employed to sense actual combustion characteristics, and, in response to the sensed combustion characteristics, the inlet geometry may be varied to obtain the total ignition delay time necessary to achieve the desired combustion characteristics. Various embodiments relate to the varying of the mass flow rate of reactants while holding the radius/velocity ratio constant.

40 Claims, 5 Drawing Sheets

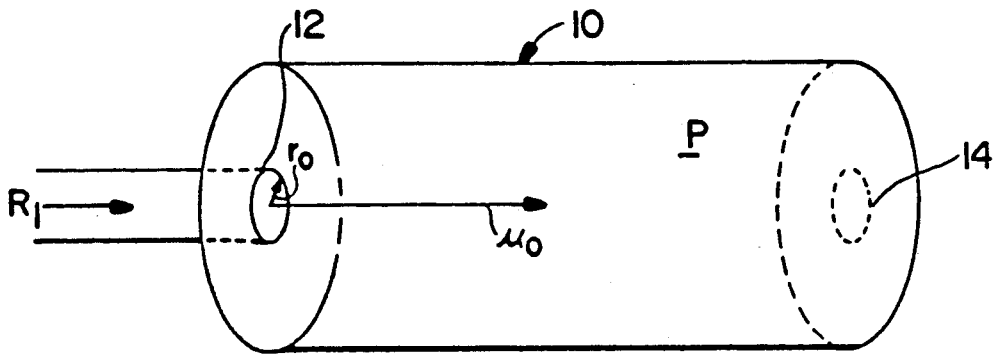
Fig. 1 — PRIOR ART
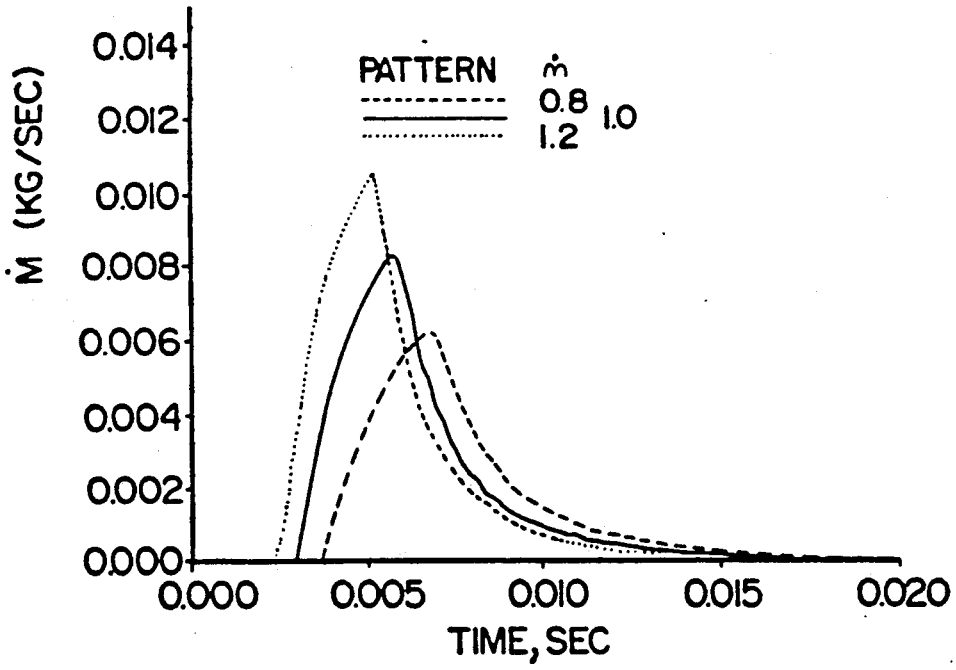
Fig. 2

Fig. 6
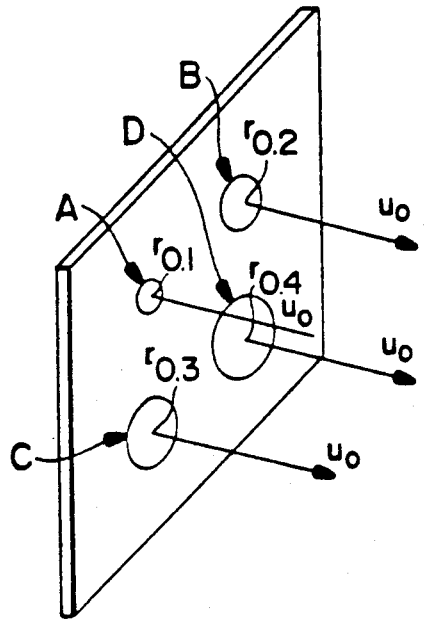
Fig. 8
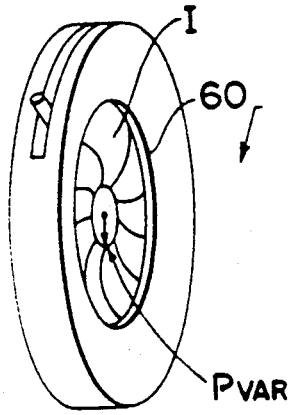
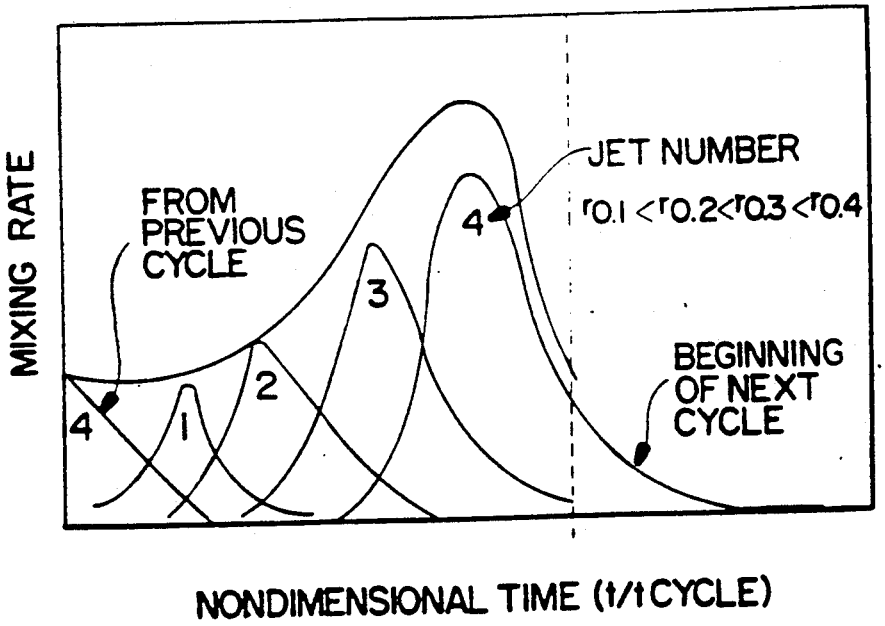
Fig. 7

METHOD AND APPARATUS FOR THE CONTROL OF FLUID DYNAMIC MIXING IN PULSE COMBUSTORS

The present invention relates generally to the control of pulse combustors. More particularly, the present invention relates to a method and apparatus for controlling the total ignition delay time, and thus the mixing parameters, of combustion reactants and combustion products in pulse combustors. The Government has rights in this invention pursuant to Contract No. DE-AC04-76DPOO789 awarded by the U.S. Department of Energy and AT&T Technologies, Inc.

This application is a continuation-in-part of U.S. Ser. No. 325,279, filed Mar. 17, 1989, abandoned which is pending at the time of filing this application.

BACKGROUND OF THE INVENTION

Generally, a pulse combustor includes a combustion chamber, an inlet for admitting combustion reactants (typically fuel and air) into the combustion chamber, and an outlet for expelling combustion products from the combustion chamber. Pulse combustors operate cyclically in that a charge of combustion reactants is admitted into the combustion chamber and ignited to form the combustion products, the initial ignition being assisted, preferably by a spark plug. The combustion products expand through the outlet thereby causing a partial vacuum in the combustion chamber which vacuum assists in drawing a fresh charge of combustion reactants into the combustion chamber for the next cycle. The fresh charge ignites upon mixing with the combustion products from the previous cycle, so that the operation is self-sustaining after the initial ignition.

Compared to conventional combustion systems, pulse combustors have the following attractive characteristics: two to three times higher heat transfer, an order of magnitude higher combustion intensity, one third lower emissions of oxides of nitrogen, 40% higher thermal efficiencies, and possibly self-aspiration. This combination of attributes results in favorable economic tradeoff with conventional combustors in many applications. Moreover, the enhanced heat and mass transfer associated with oscillating flow fields in pulse combustors may lead to significant improvements in industrial and chemical processes. Potential drawbacks of pulse combustors, however, are their inability to operate over a wide range of energy release rates (i.e., they have limited turn-down ratios), and their sensitivity to fuel properties, which may be highly variable geographically and temporally.

Although there are several different types of pulse combustors (i.e, the quarter-wave or Schmidt tube, the Rijke tube, the Helmholtz resonator, and the Reynst pulse pot), the underlying principle controlling their operation is the same, that is, the periodic addition of energy must be in phase with periodic pressure oscillations in order to sustain pulsations (Rayleigh's criterion). In other words, the energy release must be in phase with the resonant pressure wave. The phase relationship between the energy release and the resonant pressure wave is determined by four characteristic times of the pulse combustor system. The total delay time prior to energy release, and hence the phase relationship between the energy release rate and the resonant pressure wave, is a monotonically increasing function of three of the nearly independent characteristic times.

In spite of this apparent simplicity, the processes that occur in a pulse combustor are very complicated. They involve a three-dimensional, transient flow field that is highly turbulent and has variable physical properties. They further involve a resonant pressure field and a large transient energy release, the characteristic times of which may be on the same order of magnitude as the characteristic times for chemical reactions and fluid dynamic mixing. Moreover, all aspects of the combustion system are highly coupled.

The above-referenced characteristic times are the species mixing time, the fluid dynamic mixing time, the chemical kinetics ignition delay time, and the characteristic acoustic time; the first three of these characteristic times constitute the total ignition delay time.

There are many factors that, through their impact on these characteristic times, can affect the operational performance of a pulse combustor. For example, fuel properties, turn-down ratios, heat transfer, and equivalence ratios all have significant influences on the performance of a pulse combustor. However, of these times, the fluid dynamic mixing time scale appears to exhibit the strongest influence on the total ignition delay time, and thus performance of a pulse combustor. Because the various relevant time scales may all be comparable, and because the fluid dynamic mixing time is controllable, the fluid dynamic mixing time scale may be used to compensate for variations in other time scales as well as to achieve a desired operating condition.

SUMMARY OF THE INVENTION

It is an object of the present invention to eliminate the aforementioned potential drawbacks in known pulse combustors by providing a method and apparatus for controlling the total ignition delay time, and thereby for controlling the fluid dynamic mixing time of the pulse combustor, by controlling injection of combustion reactants into the combustion chamber.

It is a further object of the present invention to provide a method and apparatus for controlling the combustion process by controlling the total ignition delay time, or the time between injection of fresh reactants into hot combustion products from a previous cycle to combustion of the mixed reactants and products. This control may be either dynamic, through the use of an appropriate feedback mechanism, or static.

To achieve these and other objects, the invention relates to a method and apparatus for controlling combustion characteristics in a pulse combustor comprising a combustion chamber containing combustion products from a previous cycle, an outlet mechanism for expelling combustion products from the combustion chamber, and an inlet mechanism having an inlet geometry for cyclically introducing combustion reactants with a predetermined velocity and mass flow rate into the combustion chamber in phase with periodic pressure oscillations of the combustion products contained in the combustion chamber. The inventive method and apparatus control the total ignition delay time of the combustion reactants and the combustion products with the inlet geometry of the inlet mechanism. The ignition delay time is a function of this inlet geometry, as it is proportional to the ratio of a characteristic inlet dimension and a characteristic inlet velocity. As used herein, the term "as a function of" is intended to mean the relationship or nexus between a selected inlet geometry and its consequent effect on the mixing time of the combustion reactants and the combustion products.

In "The Role of Fluid Dynamic Mixing in Pulse Combustors", Sandia Report SAND87-8622, Apr. 1987, pp. 15-16, Bramlette discloses earlier work precursory to this invention concerning mixing rate as a function of time, the effect of a circular nozzle radius on mixing time, and the cubic dependence of mixing time and nozzle radius. However, neither the above-described reference nor any other prior art source has disclosed the the role of inlet geometry as a whole in controlling total ignition time, and thereby the resulting pulse combustor operation, and in tailoring a pulse combustion system to overcome the previously encountered problems and/or limitations in pulse combustor technology.

Particular embodiments of the present invention follow from the control of the ignition delay time and provide the following improvements in pulse combustor technology: (1) a method and apparatus for tailoring the temporal location of the energy release rate to obtain the desired pulse combustor operation; (2) a method and apparatus for extending the turn-down-ratio of pulse combustors; and (3) a method and apparatus for compensating for fuel composition effects. Each embodiment employs a particular inlet geometry to effect a desired total ignition delay time. The inlet geometry may be fixed or variable.

Thus, this invention effects the desired control of the total ignition delay time by modifying or adjusting the injection geometry of the reactant inlet. In preferred embodiments, the invention can be utilized either statically or dynamically. Static application of this invention may be obtained at the time of manufacturing or field maintenance of the pulse combustor by setting the injection geometry to effect the desired changes in the fluid dynamic mixing time scale to thereby achieve the desired ignition delay time and operating conditions. Dynamic application of this invention may be obtained by monitoring a suitable system parameter (for example, combustion chamber pressure, frequency of operation, or chemiluminescense) and, through a suitable feedback loop, controlling the injection geometry again to effect the desired changes in the fluid dynamic mixing time scale to thereby achieve the desired ignition delay time and operating conditions.

Described herein are several geometries designed to effect the fluid dynamic mixing time scale to achieve the desired pulse combustion operation. These geometries are not exhaustive, but rather serve as examples of this invention.

BRIEF DESCRIPTION OF THE DRAWINGS

The invention will be described in detail with reference to the attached Figures, wherein:

FIG. 1 is a representation of the structure of a pulse combustor, as known in the prior art;

FIG. 2 is a graph of theoretical predictions of the effect of mass flowrate on mixing time in a pulse combustor;

FIG. 6 is a schematic representation of a multiple jet injection geometry having injection jets of differing radii in accordance with a second embodiment of the invention;

FIG. 7 is a graph showing the mixing rate versus time in a pulse combustor having multiple jets of differing radii in accordance with FIG. 6;

FIG. 8 is a schematic representation of an injection system according to a third embodiment of the present invention.

DETAILED DESCRIPTION OF THE PREFERRED EMBODIMENTS

Figure 4:
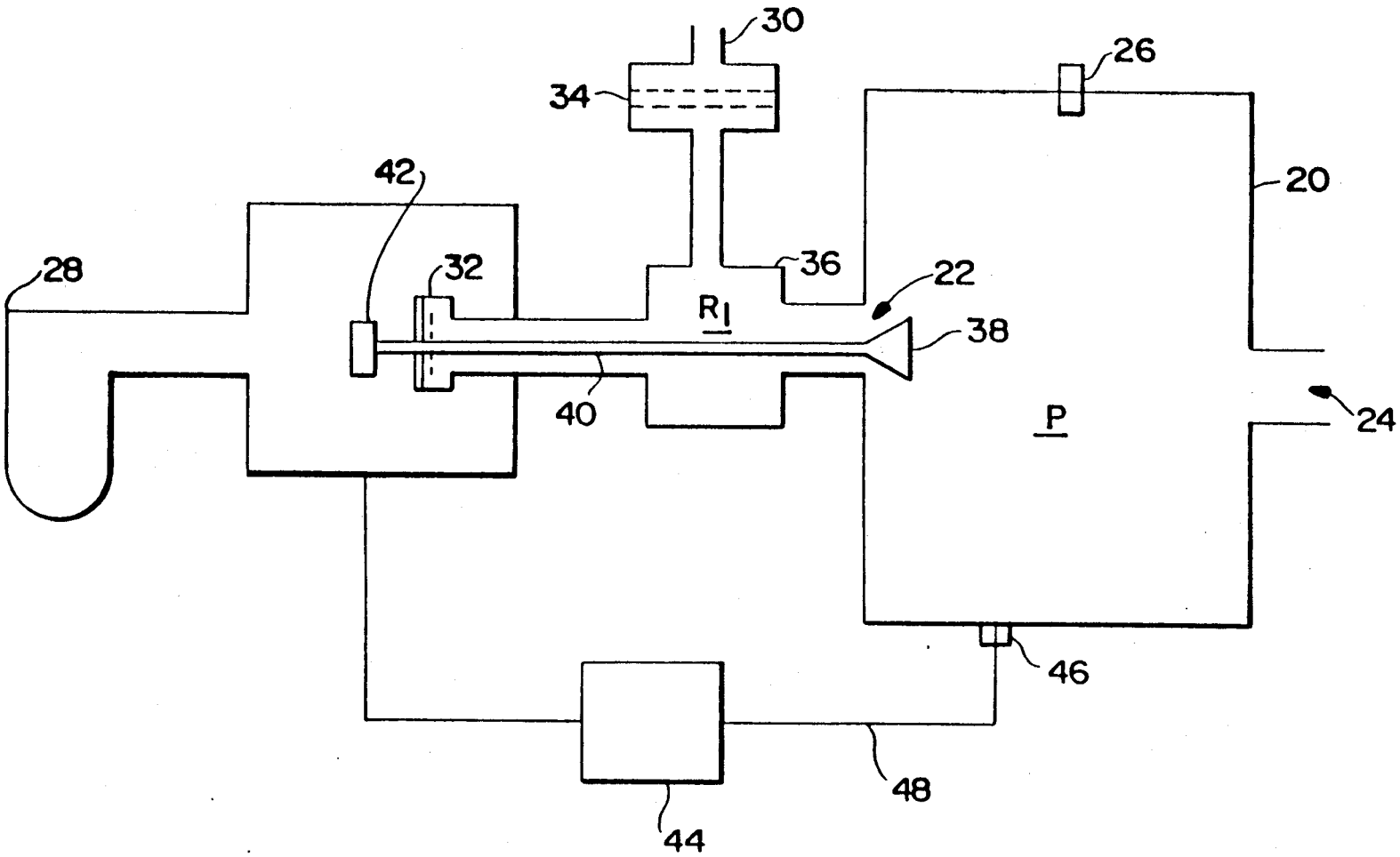
FIG. 4 is a schematic representation of a pulse combustor incorporating the features of the present invention.

An inherent characteristic of pulse combustors is the fluid dynamic mixing of fresh reactants with the combustion products of the previous cycle. Fluid dynamic mixing is known to be important to the operation of pulse combustors, largely as a consequence of testing a variety of configurations that had different mixing characteristics. Until recently the precise role of mixing, however, was not quantified either experimentally or theoretically.

There are four characteristic times, which are nearly independent, that determine the phase relationship between the energy release and the resonant pressure wave, that is required to sustain pulsations in a pulse combustor. These times are identified and defined as follows:

The species mixing time, $t_{species}$, which is the characteristic time required to mix the fuel and air;

the fluid dynamic mixing time, $t_{mixing}$, which is the characteristic time required to mix the reactants with the residual products to an appropriate reaction temperature or temperature for ignition, $T_{mix}$, or the time from the introduction into the combustion chamber of an element of reactants to the time that element of reactants reaches the temperature $T_{mix}$, and which is a function of inlet orifice dimension and injection velocity;

the chemical kinetics ignition delay time, $t_{kinetic}$, which is the characteristic time required for chemical reaction to occur, or the delay between the time when the reactants reach temperature $T_{mix}$, and the time when rapid reactions begin; and the characteristic acoustic time, $t_{acoustic}$, which is the reciprocal of the natural resonance frequency.

The first three times (species mixing time, fluid dynamic mixing time, and chemical kinetics ignition delay time) may be added to estimate the total ignition delay time, $t_{ign}$, which is the time between injection of reactants and combustion. In support of the description of the invention presented herein, species mixing time was held to be zero, because combustion reactants were premixed; however, these concepts are also valid for other systems in which combustion reactants are not premixed and thus $t_{species}$ is not zero. Since the species mixing time contributes very little to the total ignition delay time, a first order approximation of the total ignition delay time may be made more simply by the sum of the chemical kinetics ignition delay time and the fluid dynamic mixing time. The phase relationship between the release of energy and the resonant pressure wave is controlled by the relative magnitude between this total ignition delay time and the resonant pressure wave. Thus, in order to satisfy Rayleigh's Criterion, this total ignition delay time must be some fraction of the characteristic resonance time of the entire system.

The mixing rate $\dot{m}_{mix}$ is the rate at which the combustion reactants $R_1$ mix with the combustion products P at temperature $T_p$ to achieve a temperature for ignition $T_{mix}$. For example, for methane, $T_{mix}$ is approximately 1500K, a temperature for which ignition, and thus energy release, will occur approximately 1 ms later (i.e., a chemical kinetics ignition delay time of 1 ms). The mixing rate is therefore a measure of the rate of energy release. For other fuels, different values of $T_{mix}$ and chemical kinetics ignition delay time are obtained.

The method and apparatus of the invention described herein control the total ignition delay time by controlling the characteristic fluid dynamic mixing time through changes in the inlet geometry, and thus the injection characteristics of the pulse combustor, based on findings that the characteristic fluid dynamic mixing time contributes to over 80% of the total ignition delay time. This control over fluid dynamic mixing time provides a means to compensate for manufacturing variability, changing fuel properties, and different combustor firing rates, along other parameters described herein.

FIG. 1 is a model of a typical prior art pulse combustor, provided herein to identify the important system operating and geometric parameters that determine fluid dynamic mixing time and to demonstrate quantitatively the fluid dynamic mixing characteristics of known pulse combustors.

Referring to FIG. 1, a combustion chamber 10 includes an inlet 12 and an exit 14. A charge of combustion reactants $R_1$ such as fuel and air at a temperature of $T_R$ is injected through the inlet 12 into the combustion chamber 10 containing combustion products P from a previous combustor cycle at temperature $T_P$. The inlet 12, which can be circular or noncircular, is preferably an orifice or jet having a characteristic dimension $d_o$ and the injection velocity of the combustion reactants is $u_o$ (determined from the average mass flowrate of the combustion reactants, $\bar{M}$, and the continuity equation). Dimension $d_o$ is a "characteristic" dimension, since it is a dimension that cannot be precisely defined for noncircular inlets; likewise, $u_o$ is a characteristic velocity that cannot be precisely defined for such inlets.

The theoretical basis for this invention is the realization that fluid dynamic mixing time is a function of a distance divided by velocity. More particularly, as reported by Bramlette, SAND87-8622, $$\dot{m}_{mix}(t) = 2\pi u_o \rho_R f r_o^2 \int_{\xi(t-t_{inj})}^{\xi(t)} \bar{u}(\bar{x}_f,\xi)\bar{r}^2(\bar{x}_f,\xi)\xi d\xi.$$

where $$\bar{x}_f = \left(\frac{1}{D_3 f}\right)(1 - \xi^{1.5} + E_3 f).$$

$\bar{r}$ is obtained from $$\frac{d\bar{r}}{d\bar{x}} = 0.22[(B_2 + (0.5\,A_2 - C_2)\bar{u}_m)/(B_2 + (A_2 - C_2)\bar{u}_m)].$$

and

-continued $$\bar{u}(\bar{x}_f,\xi) = \frac{(1 - \xi^{1.5})^2}{A_2\bar{x}_f - B_2}.$$

Simplifying this equation, it is seen that fluid dynamic mixing time is a function of the characteristic inlet dimension $d_o$ divided by the characteristic velocity $u_o$. For the purposes of this equation, the characteristic dimension used was a characteristic radius $r_o$. This information is used in this invention as the basis for controlling the fluid dynamic mixing time by adjusting the inlet geometry, thereby affecting the characteristic inlet dimension and the characteristic velocity.

Figure 3:
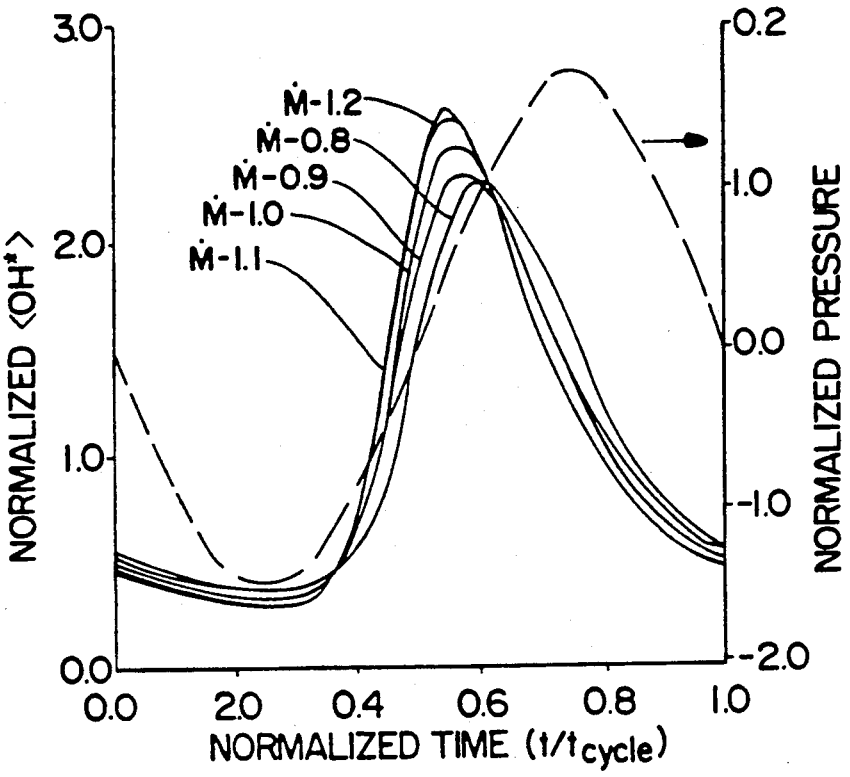
FIG. 3 is a graph of experimental results showing the effects of mass flowrate on energy release in a pulse combustor.

The aforementioned theory is validated by the results shown in FIGS. 2 and 3.

FIG. 2 shows theoretical results of instantaneous mixing rate $\dot{m}_{mix}$ as a function of time for three pulses having different values of average mass flow rate $\bar{M}$ (where $\bar{M}$ is the average rate gases are put into the chamber during the pulse, a value calculated by integrating each pulse curve). The average mass flowrate of the reactants, $\bar{M}$, has a dramatic effect on the mixing characteristics of the reactants. The theory predicts that the initial slope of the mixing rate, and the peak mixing rate, both decrease with decreasing mass flowrates.

The results of experiments, shown in FIG. 3, verify the theoretical predictions of FIG. 2, even though the theoretical results shown in FIG. 2 are for a single inlet, while the experimental results in FIG. 3 are for a configuration with multiple inlets that may interact with each other.

FIG. 3 shows measurements of scaled <OH*-> chemiluminescence, a measure of energy release rate and an indicator of the occurrence of combustion, as a function of time for various average mass flowrate input pulses in a multiple input combustion chamber. The timing of the upward slopes (indication that combustion is occurring) indicates that combustion occurs faster when mass flowrate is increased. As predicted by the theory, the amount of combustion is greater, and occurs sooner, for larger values of average mass flowrate. Thus, the mixing time of pulse combustors scales with, i.e. is proportional to, the ratio of the characteristic inlet dimension of the inlet orifice over injection velocity, $d_o/u_o$. This scaling of characteristic quantities (characteristic dimensions and characteristic velocities) is a monotonic function, as illustrated by the initial rising curves of FIGS. 2 and 3.

Also, based on the theory, as verified by experiments, this invention then teaches that mass flowrate limits the range of combustor operations and explains the inability of most pulse combustors to operate at a wide range of energy release rates and to obtain desirable ranges of turn-down ratios.

Pulse combustors are optimized when the combustion resulting from each input pulse is in phase with the combustion resulting from the previous pulse. This invention teaches several different systems for controlling the combustion time, ultimately the total ignition delay time, by varying the inlet geometry to achieve the optimum time for pulse combustion.

One preferred method and apparatus in accordance with the invention for controlling the total ignition delay time of the combustion reactants and the combustion products as a function of the inlet geometry is illustrated schematically in the pulse combustor of FIG. 4. The combustion chamber 20 includes an inlet 22, and outlet 24 and a spark plug 26 for igniting the initial charge of reactants $R_1$. The reactants preferably are air from a blower 28 upstream of the inlet 22 and fuel from a fuel supply inlet 30. Air passes through an air inlet valve 32 while fuel is dispersed through a fuel inlet valve 34, the fuel and air mixing in a mixing chamber 36. It is noted, however, that the invention is applicable to systems employing premixed or non-premixed reactants.

The reactants $R_1$ enter the chamber 20 through the inlet 22 having an inlet geometry which can be fixed or variable. The inlet 22 in FIG. 4 has a variable inlet geometry in that a movable center body 38 varies the inlet geometry of the inlet 22, thereby modifying the fluid dynamic mixing time scale, and thereby the total ignition delay time, of the combustion reactants $R_1$ and products P in the chamber 20. The movable center body 38 is moved through a linkage 40 by an actuator 42, preferably located upstream of the air inlet valve 32.

In dynamic or feedback controlled applications, the actuator 42 is controlled by a microprocessor 44 which receives signals from sensors 46 in the combustion chamber 20. The sensors may monitor actual combustion characteristics such as pressure, frequency and/or chemiluminescense, and convey those signals through a feedback loop 48 back to the microprocessor 44 for comparison with desired combustion characteristics. Any deviation between desired and actual combustion characteristics results through signal processing in selective actuation of the actuator 42 to vary the inlet geometry of the inlet 22 (by movement of the center body 38 relative to the inlet 22) and thus modify the characteristic mixing times of the combustion reactants $R_1$ and products P, which consequently modifies the combustion time.

Figure 5:
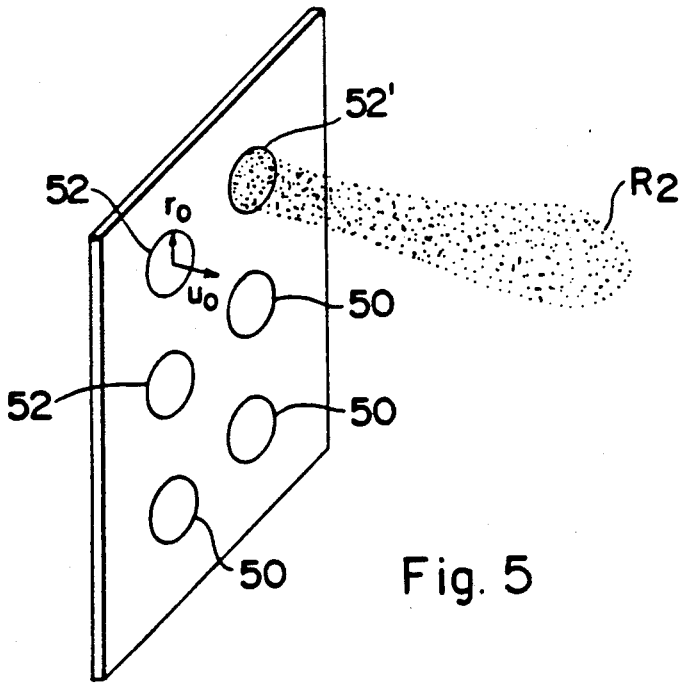
FIG. 5 is a schematic representation of a multiple jet injection geometry according to one embodiment of the present invention.

In one preferred embodiment of the invention described above, the concepts of the present invention are employed in a control mechanism for adjusting the turn-down ratio of a pulse combustor. Therefore, an injection system in which $d_o/u_o$ was held constant while the mass flowrate, M, of reactants was varied would result in constant mixing characteristics over a wide range of turn-down ratios. One method and apparatus to accomplish this variation of mass flowrate uses a fixed injection geometry shown in FIG. 5. In this case, as in the equation shown previously, the characteristic dimension $d_o$ may be termed a characteristic radius $r_o$. In FIG. 5, six individual injection inlet orifices or jets are shown but more or less could be employed. The closed jets 50 are shown as darkened circles whereas open jets 52 are indicated by open circles. Each jet has a fixed radius $r_o$ and thus a fixed geometry. Injection jet 52' shows a reactant charge $R_2$ passing therethrough. By successively closing individual jets as the mass flowrate is reduced, it is possible to maintain a constant value of injection velocity ($u_o$). Likewise, as mass flowrate is increased, individual jets may be opened. Since the jet radius ($r_o$) is fixed, the ratio $r_o/u_o$ is constant, ensuring that the mixing characteristics are invariant.

As discussed above in FIG. 4, an appropriate feedback system cooperating with the individual jets could be used to determine pressure measurements in the combustion chamber and provide the mechanics to control opening and closing of the jets in response to the determined pressure. Other possible control means include feedback systems coupled with either a method of monitoring characteristics of combustion process signals such as determining the frequency of the combustion cycle or a chemiluminescence measurement system which determines precisely when energy release occurs.

Another embodiment of the present invention relates to the optimization of temporal energy release rates in pulse combustors. The strongest, most stable operation of a pulse combustor occurs when the energy release rate is in phase with, and at the peak of, the resonant acoustic pressure field. Since energy release rate is a function of the mixing time, the energy release rate can be tailored through the selection of a variety of injection jet geometries. Again, this theory is based on the discovery that mixing time is a function of the ratio $d_o/u_o$.

A schematic of a geometric configuration that could be used to tailor the energy release rate is shown in FIG. 6. Here again, the characteristic dimension $d_o$ is considered to be a characteristic radius $r_o$. Flow through all jets A, B, C and D is initiated simultaneously. Each jet (A, B, C, D) has a different radius ($r_{o1}$, $r_{o2}$, $r_{o3}$, $r_{o4}$, respectively). In this Figure, injection jet $r_{o3}$ shows the reactant charge $R_2$ passing therethrough. Since the injection velocity of each jet is the same, while $r_o/u_o$ varies, it is possible to vary the mixing time of each jet, since the mixing time scales with $r_o/u_o$. By selecting jet radii and summing the mixing rates of all of the jets, shown graphically in FIG. 7, any desired temporal mixing profile may be obtained. Through the use of chamber pressure, cycle frequency or chemiluminescence measurements, an optimum temporal mixing profile may be tailored for virtually any pulse combustor apparatus using a feedback loop as discussed with reference to FIG. 4.

Another embodiment of the present invention relates to accounting for variations associated with variable fuel properties in a pulse combustor. Fuel properties can also affect pulse combustor performance. For example, in a Helmoltz-type pulse combustor operating in a non-premixed mode, changes of 1 ms in the chemical kinetics time scale out of a system acoustic time scale of 20 ms (accomplished by modifying the fuel's chemical properties) resulted in a dramatic effect on system performance. Specifically, theoretical models predict that for a fixed mass flow rate of fuel and air (operation at a constant firing rate) the mixing time scales with $(d_o)^3$. Any of the above-described embodiments can be used to compensate for variations in fuel properties. Minor variation in $d_o$ could also be used to compensate for these variations. One possible physical configuration for accomplishing this compensation for fuel composition effects is illustrated in FIG. 8. FIG. 8 shows an injection system wherein the injection orifice 60 has a variable geometry with a variable characteristic dimension $d_o$; for purposes of the description here again, the characteristic dimension is a variable characteristic radius $r_{var}$ attained through the use of an adjustable iris I; in this Figure, the variable radius $r_{var}$ of the injection jet 60 shows the reactant charge $R_2$ passing therethrough. The variable radius $r_{var}$ of the injection orifice 60 allows for the compensation of variations in fuel properties. Thus, slight changes in $u_o$ are compensated for by changes in $r_o$ to render $r_o/u_o$ constant. A feedback control means may be provided for adjusting $r_o$ in response to a determination of the chamber pressure, cycle frequency, or reaction chemiluminescence which indicate energy release times.

Figure 9A:
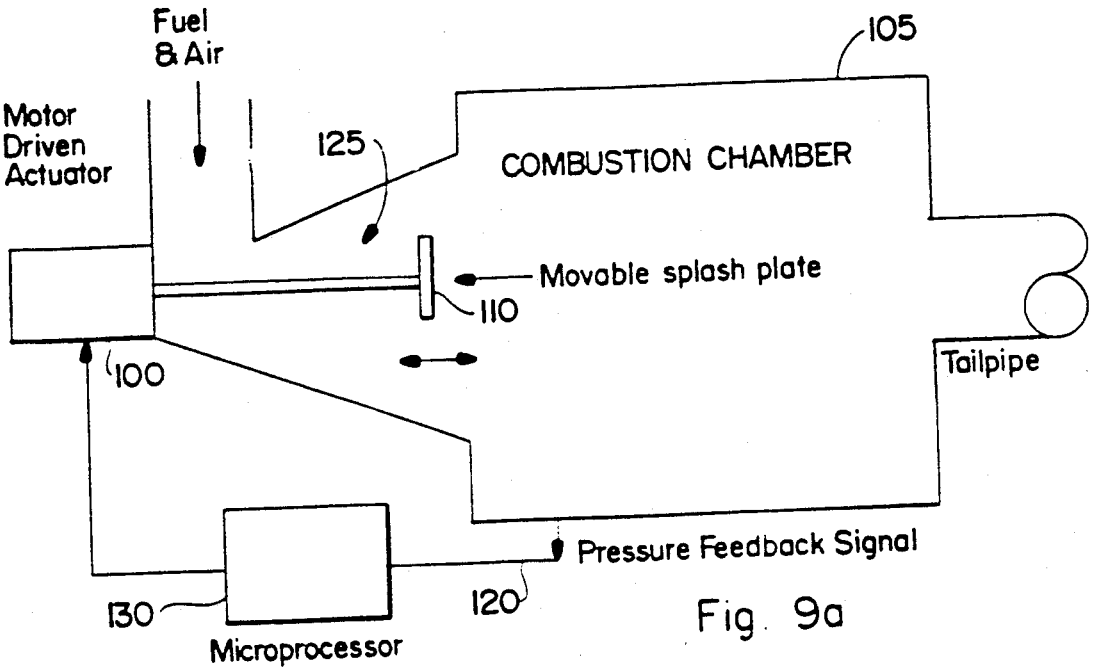
FIGS. 9*a* and 9*b* illustrate two embodiments of the present invention which utilize variable inlet geometries to control ignition delay time and thus fluid dynamic mixing.

In two other embodiments of the present invention (FIGS. 9*a* and 9*b*), injection jets are formed by an injection orifice and a movable valving system that can modify the fluid dynamic mixing time scale, and thereby the total ignition delay time and related mixing characteristics of the combustor. As seen in FIG. 9*a*, a motor driven actuator 100 is used to mechanically adjust a stagnation plate valve 110 in response to a feedback loop 120 which monitors combustion characteristics. The plate valve 110 modifies the inlet geometry of the fuel/air inlet 125, and thus modulates the mixing characteristics of the premixed fuel/air reactants with the combustion products in the combustion chamber 105. Preferably, a microprocessor 130 is employed to monitor the feedback signal and actuate the actuator 100. Accordingly, desired pressure oscillations in the combustor may be maintained. Other system characteristics which may be monitored and used to control characteristic mixing times are combustion cycle frequencies and chemiluminescence.

Figure 9B:
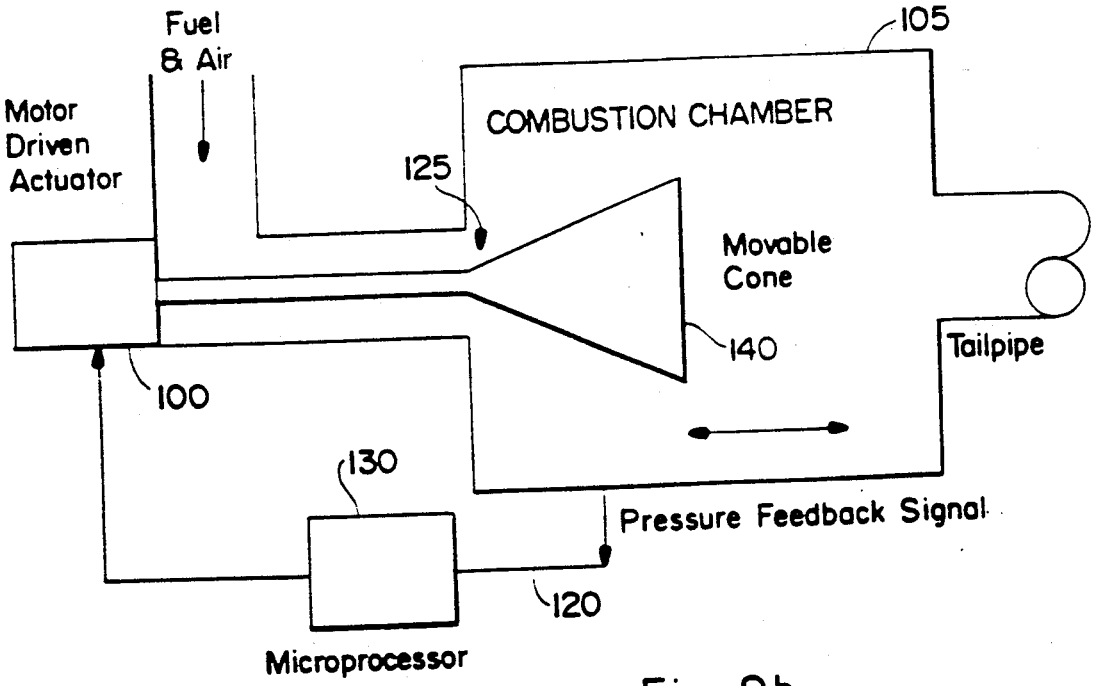

Any type of movable valve geometry could be used that would modify the fluid dynamic mixing time of the combustor. FIG. 9*b* illustrates an embodiment similar to that shown in FIG. 9*a* with the exception that FIG. 9*b* has a cone-shaped stagnation plate 140 which functions similarly to the movable stagnation plate seen in FIG. 9*a*. Depending upon the particular pulse combustor, a wide variety of stagnation plate shapes could be used to vary the inlet geometry and thus provide desired mixing and combustion times.

The present invention has been described in detail including embodiments thereof. It will be appreciated, however, that those skilled in the art, upon consideration of the present disclosure, may make modification and improvements on this invention and still be within the scope and spirit of this invention as set forth in the following claims.

What is claimed is:

1. A method for controlling combustion characteristics in a pulse combustor comprising a combustion chamber with combustion products therein, an outlet for evacuating combustion products from the combustion chamber, and an inlet means having an inlet geometry for cyclically introducing combustion reactants into said combustion chamber in phase with periodic pressure oscillations of the combustion products within said combustion chamber, said method comprising the step of:

controlling the total ignition delay time of the combustor by adjusting inlet geometry of said inlet means, said delay time being proportional to a characteristic inlet dimension divided by a characteristic inlet velocity.

2. The method of claim 1 wherein said controlling step, includes the steps of fixing the inlet geometry to statically control said ignition delay time as a function of the fixed inlet geometry.

3. The method of claim 1, wherein said controlling step includes the steps of varying the inlet geometry to dynamically control said ignition delay time as a function of the variable inlet geometry.

4. The method of claim 1, wherein said controlling step includes the step of controlling a mixing time.

5. The method of claim 1, further comprising the steps of:

sensing combustion characteristics in said combustion chamber; and varying the inlet geometry in response to the sensed combustion characteristics to obtain a desired ignition delay time.

6. The method of claim 5, wherein said sensing step includes sensing pressure in said combustion chamber.

7. The method of claim 5, wherein said sensing step includes sensing frequency of combustion in said combustion chamber.

8. The method of claim 5, wherein said sensing step includes sensing chemiluminescence.

9. The method of claim 1, wherein said inlet means includes at least one orifice having a radius, said characteristic inlet dimension is said radius of said at least one orifice, and said controlling step includes controlling said ignition delay time as a function of a ratio of said radius to said characteristic inlet velocity of the combustion reactants.

10. The method of claim 9, wherein said step of controlling said ignition delay time as a function of the radius/velocity ratio includes the step of controlling mixing time as a function of the radius/velocity ratio.

11. The method of claim 10, wherein said mixing time varies monotonically with the radius/velocity ratio.

12. The method of claim 10, wherein said at least one orifice has a variable radius, and said controlling step includes the step of selectively varying the radius of the orifice while holding the mass flow rate constant to vary the mixing time as a function of the selected radius and thereby compensate for variations in combustion reactant properties.

13. The method of claim 12, wherein said mixing time varies with the cube of the selected radius.

14. The method of claim 9, wherein said controlling step includes the step of holding the radius/velocity ratio constant while varying mass flowrate of the combustion reactants to obtain constant mixing characteristics over a range of turn-down ratios.

15. The method of claim 14, wherein said at least one orifice of said inlet means includes a plurality of selectively closable inlet orifices having equal radii, and said controlling step includes selectively closing a portion of said plurality of inlet orifices to maintain constant velocity, thereby holding said radius/velocity ratio constant to obtain constant mixing characteristics.

16. The method of claim 14, wherein said at least one orifice of said inlet means includes a plurality of orifices having unequal radii, and said controlling step includes the step of varying the mixing time of each jet by equalizing the velocity of combustion reactants flowing through each orifice of said plurality of orifices to obtain a desired mixing profile.

17. The method of claim 1, wherein said inlet means includes a valve and an inhibitor of flow through said valve, and said controlling step includes varying an opening degree of said valve by changing the relative position of said valve and said flow inhibitor in said valve.

18. The method of claim 17, wherein said flow inhibitor is a movable splash plate.

19. The method of claim 17, wherein said flow inhibitor is a movable cone.

20. The method of claim 17, further comprising the steps of:

sensing combustion characteristics in the combustion chamber; and varying the relative position of said flow inhibitor and said valve in response to the sensed combustion characteristics to obtain a desired ignition delay time.

21. An apparatus for controlling combustion characteristics in a pulse combustor comprising a combustion chamber with combustion products therein, an outlet for evacuating combustion products from the combustion chamber, and an inlet means having an inlet geometry for cyclically introducing combustion reactants into said combustion chamber in phase with periodic pressure oscillations of the combustion products within said combustion chamber, said apparatus further comprising:

means for controlling the total ignition delay time of the combustor, said means for controlling including means to adjust the inlet geometry of said inlet means, said delay time being proportional to a characteristic inlet dimension divided by a characteristic inlet velocity.

22. The apparatus of claim 21, wherein said controlling means includes means for fixing said inlet geometry to statically control said ignition delay time as a function of the fixed inlet geometry.

23. The apparatus of claim 21, wherein said controlling means includes means for varying said inlet geometry to dynamically control said ignition delay time as a function of the variable inlet geometry.

24. The apparatus of claim 21, wherein said controlling means includes means for controlling a mixing time.

25. The apparatus of claim 21 further comprising:

means for sensing combustion characteristics in said combustion chamber; and means for varying said inlet geometry in response to the sensed combustion characteristics to obtain a desired ignition delay time.

26. The apparatus of claim 25, wherein said sensing means includes means for sensing pressure in said combustion chamber.

27. The apparatus of claim 25, wherein said sensing means includes means for sensing frequency of combustion in said combustion chamber.

28. The apparatus of claim 25, wherein said sensing means includes means for sensing chemiluminescence.

29. The apparatus of claim 21, wherein said inlet means includes at least one orifice having a radius, said characteristic inlet dimension is said radius of said at least one orifice, and said controlling means includes means for controlling said ignition delay time as a function of a ratio of said radius to said characteristic inlet velocity of the combustion reactants.

30. The apparatus of claim 29, wherein said means for controlling said ignition delay time as a function of the radius/velocity ratio includes means for controlling mixing time as a function of the radius/velocity ratio.

31. The apparatus of claim 30, wherein said mixing time varies monotonically with said radius/velocity ratio.

32. The apparatus of claim 31, wherein said at least one orifice of said inlet means includes a plurality of orifices having unequal radii, and said controlling means includes means for varying the mixing time of each jet by equalizing the velocity of combustion reactants flowing through each orifice of said plurality of orifices to obtain a desired mixing profile.

33. The apparatus of claim 30, wherein said at least one orifice has a variable radius, and said controlling means includes means for selectively varying said radius of said orifice while holding the mass flow rate constant to vary the mixing time as a function of the selected radius and thereby compensate for variations in combustion reactant properties.

34. The apparatus of claim 33 wherein said mixing time varies with the cube of the selected radius.

35. The apparatus of claim 29, wherein said controlling means includes means for holding the radius/-velocity ratio constant while varying mass flowrate of the combustion reactants to obtain constant mixing characteristics over a range of turn-down ratios.

36. The apparatus of claim 35, wherein said at least one orifice of said inlet means includes a plurality of selectively closable inlet orifices having equal radii, and said controlling means includes means for selectively closing a portion of said plurality of inlet orifices to maintain constant velocity, thereby holding said radius/velocity ratio constant to obtain constant mixing characteristics.

37. The apparatus of claim 21 wherein said inlet means includes a valve and an inhibitor of flow through said valve, and said controlling means includes means for varying an opening degree of said valve by changing the relative position of said valve and said flow inhibitor in said valve.

38. The apparatus of claim 37 wherein said flow inhibitor is a movable splash plate.

39. The apparatus of claim 37 wherein said flow inhibitor is a movable cone.

40. The apparatus of claim 37 further comprising:

means for sensing combustion characteristics in the combustion chamber; and means for varying the relative position of said flow inhibitor and said valve in response to the sensed combustion characteristics to obtain a desired ignition delay time.

* * * * *